US005167226A

United States Patent [19]

Laroche et al.

[11] Patent Number: 5,167,226

[45] Date of Patent: Dec. 1, 1992

[54] COMBINED CLAPPING AND VIBRATING DEVICE FOR EXPELLING RETAINED OBSTRUCTIVE SECRETIONS IN THE LUNGS

[75] Inventors: Louis Laroche, St-Lambert; Pierre Gauthier, Boucherville; Joe Serrano, Montreal; Pierre Girard, St-Marc sur Richelieu, all of Canada

[73] Assignees: Hydro-Quebec; Bell Canada, both of Montreal, Canada

[21] Appl. No.: 591,378

[22] Filed: Oct. 1, 1990

[30] Foreign Application Priority Data

Apr. 19, 1990 [CA] Canada ..... 2014929

[51] Int. Cl.[5] ..... A61H 1/00; A61H 7/00

[52] U.S. Cl. ..... 128/55; 128/52; 128/36

[58] Field of Search ..... 128/51, 52, 53, 54, 128/55, 32, 33, 44, 61, 67

[56] References Cited

U.S. PATENT DOCUMENTS

| | | | |
|---|---|---|---|
| 1,833,103 | 11/1931 | Anderson | 128/55 |
| 1,955,623 | 4/1934 | Donoway | 128/55 |
| 2,714,381 | 8/1955 | Corley et al. | 128/61 |
| 3,209,747 | 10/1965 | Guentner | 128/55 |
| 3,277,887 | 10/1966 | Thomas | 128/54 X |
| 3,425,409 | 2/1969 | Isaacson et al. | 128/54 |
| 3,601,122 | 8/1971 | Guertin | 128/55 |
| 3,955,563 | 5/1976 | Maione | 128/55 X |
| 4,102,334 | 7/1978 | Muchisky | 128/55 X |
| 4,196,722 | 4/1980 | Vanderwoude | 128/67 X |
| 4,326,507 | 4/1982 | Barkalow | 128/54 |
| 4,429,688 | 2/1984 | Duffy | 128/54 X |
| 4,508,107 | 4/1985 | Strom et al. | 128/54 |
| 4,984,568 | 1/1991 | Persand | 128/55 X |

*Primary Examiner*—Robert A. Hafer
*Assistant Examiner*—Brian E. Hanlon
*Attorney, Agent, or Firm*—Oblon, Spivak, McClelland, Maier & Neustadt

[57] ABSTRACT

A treatment device and a method for simultaneously applying vibrations and percussion forces to a predetermined area of a patient's body adjacent the lungs of the patient. The device comprises a housing having a handle portion. A clapping head is disposed exteriorly of the housing and connected to a reciprocable element which is imparted a set low frequency reciprocation movement by a low frequency generation device to impart a clapping action to the head. The head has a contact surface for engagement with the predetermined area of the patient's body. An independent vibrator element is also provided and has a body engaging member which is disposed in relation to the clapping head and connected to a vibration generating device capable of vibrating the vibrator element at a higher predetermined frequency than the reciprocation movement of the clapping head. Preferably, the clapping frequency is in the range of from 0.5 Hz to 2 Hz and the vibration frequency is in the range of from 40 Hz to 70 Hz.

23 Claims, 2 Drawing Sheets

COMBINED CLAPPING AND VIBRATING DEVICE FOR EXPELLING RETAINED OBSTRUCTIVE SECRETIONS IN THE LUNGS

BACKGROUND OF INVENTION

1. Field of the Invention

The present invention relates to a treatment device and method for simultaneously applying vibrations and percussion forces to a predetermined body area of a patient adjacent the lungs whereby to cause the lungs to expel retained obstructive secretions nd wherein the clapping and vibration forces are applied simultaneously at predetermined frequencies which are adjustable within specific frequency ranges.

2. Description of Prior Art

Various techniques have been utilized in order to treat patients who have certain pulmonary diseases such as cystic fibrosis, emphazema, bronchitis. Particularly some of the treatments comprise delivering a series of rapid and gentle blows with the open hand to the chest cage over the area of the lung which contains air passages which are obstructed with mucous secretions. This technique has been used for many years and has become recognized as an aid in combating bronchial obstructions. However, the effectiveness of the chest clapping depends largely upon the skill and patience of the therapist. U.S. Pat. No. 4,079,733 proposes a vibrator device to assist the therapist in providing proper clapping forces by the use of a machine. This device consists of a percussion tool which delivers mechanical percussion vibrations capable of penetrating variable thicknesses of chest wall and delivering percussion blows to the lung.

However, in some cases, it has also been found desirable to treat the patient with vibrational type therapy rather than percussion therapy and such therapy has been effected by the use of well known hand vibration devices. Both types of treatment have been found to help in secreting the lungs of patients having cystic fibrosis. The use of existing electromechanical devices has therefore reduced physical strain on the therapist and have provided treatments which are more efficient. However, these machines have some disadvantages in that they still require a person to administer the treatment, and are also noisy. The percussors may also create clapping forces which are too violent for some patients, particularly younger patients.

SUMMARY OF INVENTION

It is therefore a feature of the present invention to provide a treatment device and method which subtantially overcomes the above-mentioned disadvantages of the prior art.

Another feature of the present invention is to provide a treatment device and method for simultaneously applying vibrations and percussion forces to a predetermined area of a patient's body to cause the explusion of retained obstructive secretions in the lungs of the patient.

Another feature of the present invention is to provide a treatment device and method for simultaneously applying vibrations and percussion forces to the back of a patient's body and which device and method is self-administered by the patient.

Another feature of the present invention is to provide a treatment device and method for simultaneously applying vibrations and percussion forces to a predetermined area of a patient's body and which device is provided with adjustable means whereby to vary the clapping frequency and force as well as the vibration frequency to adapt the device to the specific needs of the patient.

Another feature of the present invention is to provide a treatment device for simultaneously applying vibrations and percussion forces and wherein the device is substantially less noisy than prior art devices and utilizes independent drives for independently actuating a clapping head and transmitting vibrations to a bell-shaped support positioned about the clapping head.

Another feature of the present invention is to provide a novel articulated support arm to which the treatment device is securable to permit the patient to apply the treatment device at a precise location on his body for self-treatment.

According to the above features, from a broad aspect, the present invention provides a treatment device for simultaneously applying vibrations and percussion forces to a predetermined area of a patient's body. The device comprises a housing having a handle portion. A clapping head is disposed exteriorly of the housing and connected to a reciprocable element which is imparted a set low frequency reciprocation movement by a low frequency generation means to impart a clapping action to the head. The head has a contact surface for engagement with the predetermined area of the patient's body. An independent vibrator element is also provided and has a body engaging member which is disposed in relation to the clapping head and connected to a vibratable means. The vibratable means is connected to a vibration generation means capable of vibrating the vibrator element at a higher predetermined frequency than the reciprocation movement of the clapping head.

According to a still further broad aspect of the present invention, there is provided a method of applying clapping and vibratory forces, simultaneously, to a predetermined area of a patient's body adjacent the lungs to cause the expulsion of retained obstructive secretions in the lungs. The method comprises positioning a treatment device having a clapping head and a circumferential vibrator element with the head and element being disposed on the predetermined body area. The device is maintained in that position and then is actuated so that independent low frequency generation means will cause the clapping head to reciprocate at a frequency in the range of from 0.5 Hz to 2 Hz and the vibration generation means will cause the circumferential vibrator element to vibrate in the frequency range of from 40 Hz to 70 Hz, simultaneously.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
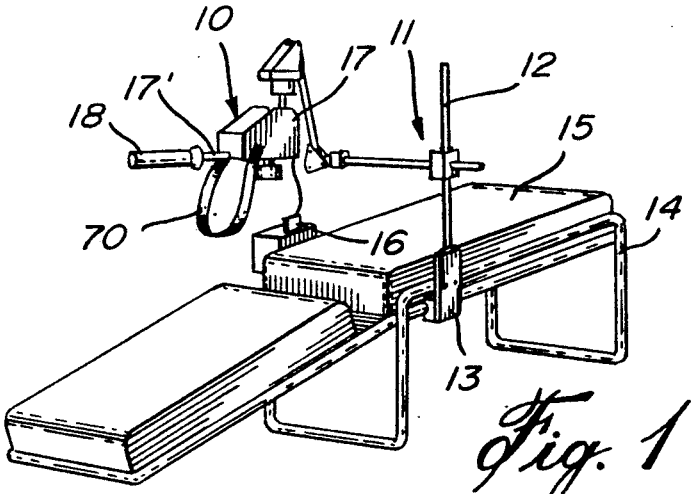
FIG. 1 is a perspective view illustrating the treatment device of the present invention as secured to an articulated support arm attached to a treatment table.

Referring to the drawings, and more particularly to FIG. 1, there is shown generally at 10, the treatment device of the present invention as secured to an articulated support arm 11. The support arm 11 is provided with a vertical post 12 which has a connector 13 at a lower end thereof, herein secured to the frame member 14 of a treatment table 15 on which a patient lies to self-position the treatment device 10 on a predetermined portion of his body in the rib cage area adjacent the lungs whereby to give himself a treatment. A control device 16 is provided for remote operation of the treatment device 10. The control device is provided with adjustable controls and switches to select the proper clapping and vibration frequencies.

The treatment device 10 is usually positioned on the patient's back or chest and to do this there is provided an elongated arm 17' having a handle portion 18.

Figure 2:
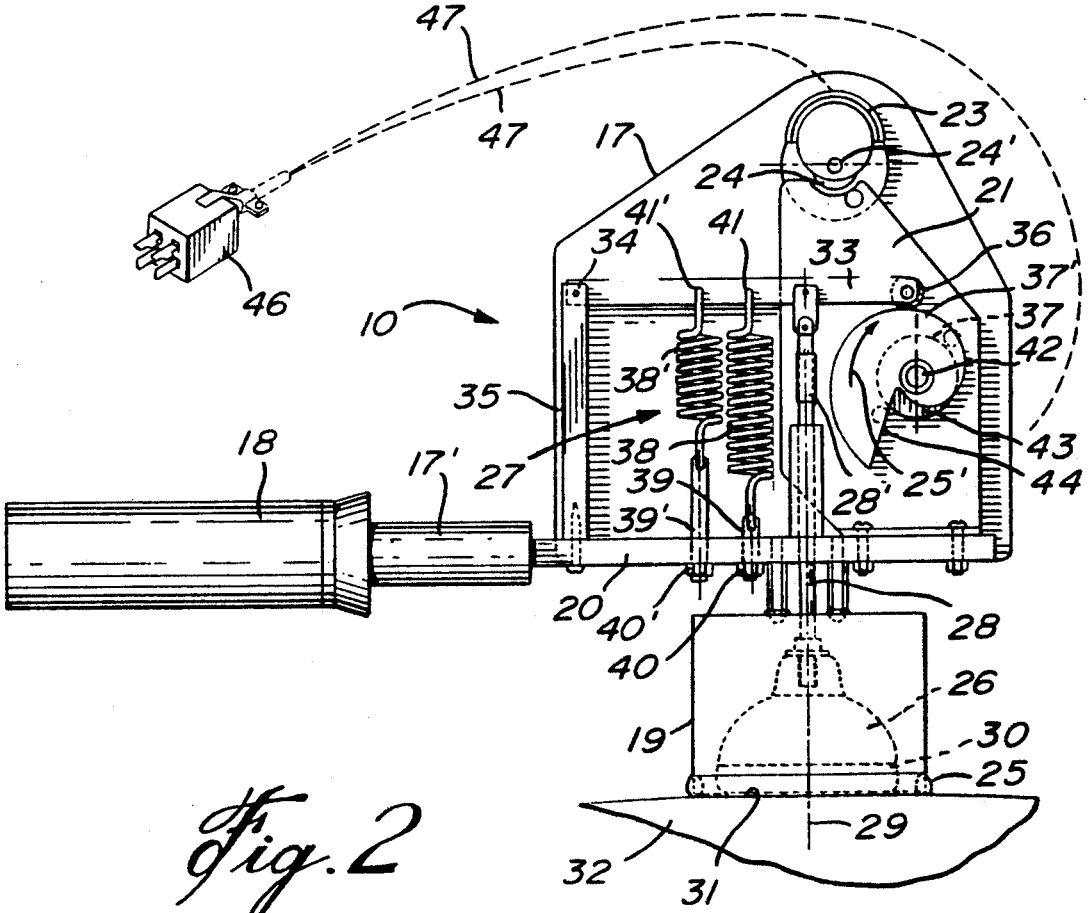
FIG. 2 is a fragmented side view illustrating the construction of the treatment device of the present invention.

Referring now to FIG. 2, there will be described the construction and operation of the treatment device 10 of the present invention. As herein shown, the treatment device consists of a housing 17 to which is secured the handle arm 17'. A bell-shaped vibrator housing 19 is secured to a bottom frame member 20 on the housing 17. A support plate 21 is provided to secure the motors, described later. A motor 24 is secured to a wall of the housing 17 and provided with an offset counter-weight 23 on its output shaft 24' to cause the entire housing 17 to vibrate. The location of the motor 24 is selected such that maximum amplitude of the vibration are transmitted to the bell-shaped housing. Therefore the bell-shaped housing 19 will vibrate as well as everything connected to the housing. A gasket-like pad 25 is secured about the circumferential free end of the housing 19 to transmit the vibrations to the patient's body and for comfort. The circumferential pad 25 also stabilizes the device on the patient's body.

Located concentrically inside the vibrator housing 19 is a clapping head 26 which is substantially bell-shaped and which is secured to a low frequency reciprocation mechanism 27 which imparts axial clapping motion to the connecting rod 28 by displacing the clapping head along the axis 29 to simulate the clapping action usually provided by the hands. Accordingly, the clapping head 26 is lifted within the bell-shaped vibrator 19 and abruptly released so that the flat body engaging pad 30 will strike the surface area 31 of the body 32 positioned thereunder. The connecting rod 28 has an adjustable part to align the bottom surface or the clapping head 26 with the outer periphery of the gasket 25 or slightly beyond this peripheral surface.

The low frequency reciprocation mechanism 27 is comprised of a reciprocating member, herein an arm 33, which is pivotally connected at one end 34 to a stationary frame member 35 of the housing. The opposed free end of the arm 33 is provided with a guide wheel and constitutes a cam engaging end which is retained in frictional abutment against the side wall 37' of a cam element 37. In order to maintain the arm 33 biased against the cam side wall 37', there is provided spring biasing means in the form of two helical springs 38 and 38' which are adjustably connected at a lower end by means of a threaded bolt 39 and 39', respectively. By rotating the nut 40 and 40', the tension of each of the springs can be adjusted thereby adjusting the impact force of the clapping head 26 against the patient's body. The upper ends of the springs 38 and 38' are secured in respective locating holes 41 and 41' provided in the arm 33.

The cam element 37 is secured to the drive shaft 42 of a further motor 43. This motor 43 is driven at low speed whereby to turn the cam slowly to produce clapping motions of the head 26 within the range of from 0.5 Hz to 2 Hz. As can be seen, the cam element 37 has a curved cam side wall portion 37' which terminates in an abrupt straight end 44 so that as the cam is rotated in the direction of arrow 45, it will lift the pivoted arm 33 on its pivot point 34 to withdraw the clapping head 26 within the bell-shaped housing 19. As soon as the guide wheel 36, at the free end of the arm, reaches the end wall 44, the arm 33 and the clapping head 36 are quickly pulled down by the action of springs 38 and 38' to impact on the surface 31 surrounded by the vibrating pad 25. The vibrating pad is simultaneously being vibrated by the offset counter-weight 23 at a frequency in the range of from 40 Hz to 70 Hz. Accordingly, the area 31 is continuously being vibrated and clapped at different frequencies by the device 10 of the present invention. The proper vibration and clapping frequency is determined to suit the needs of the patient and is adjustable by varying the speed of the motors 24 and 43. The impact force of the clapping head is also adjustable by adjusting the tension in both springs 38 and 38'. Although two springs are herein shown as being adjustable, it is obvious that only one of these may be adjustable. Alternatively, a single adjustable spring may be provided but it has been found that with the use of two springs, a better adjustment range and increase force is provided.

The elongated arm 17' with its handle 18 may also be removably connected to the housing 17 to provide arms of different shape. For example, the arm as shown in FIG. 2 is best used when the treatment device 10 is utilized by a therapist to administer the treatment. The elongated curve arm as shown in FIG. 1 is utilized when a treatment is self-administered by a person with the device connected to the support arm 11. The handle is also made from an absorbent material. An AC/DC converter is provided and the electrical connector 46 supplies DC power to damper the vibrations of the housing to both of the motors 24 and 43. By using DC motors, there is substantially less noise produced than with the use of AC motors. If a control device module is utilized to vary the speed of these motors within the frequency range, as above-described, then the control module would be connected to the leads 47 at the output of the connector 46.

Figure 3:
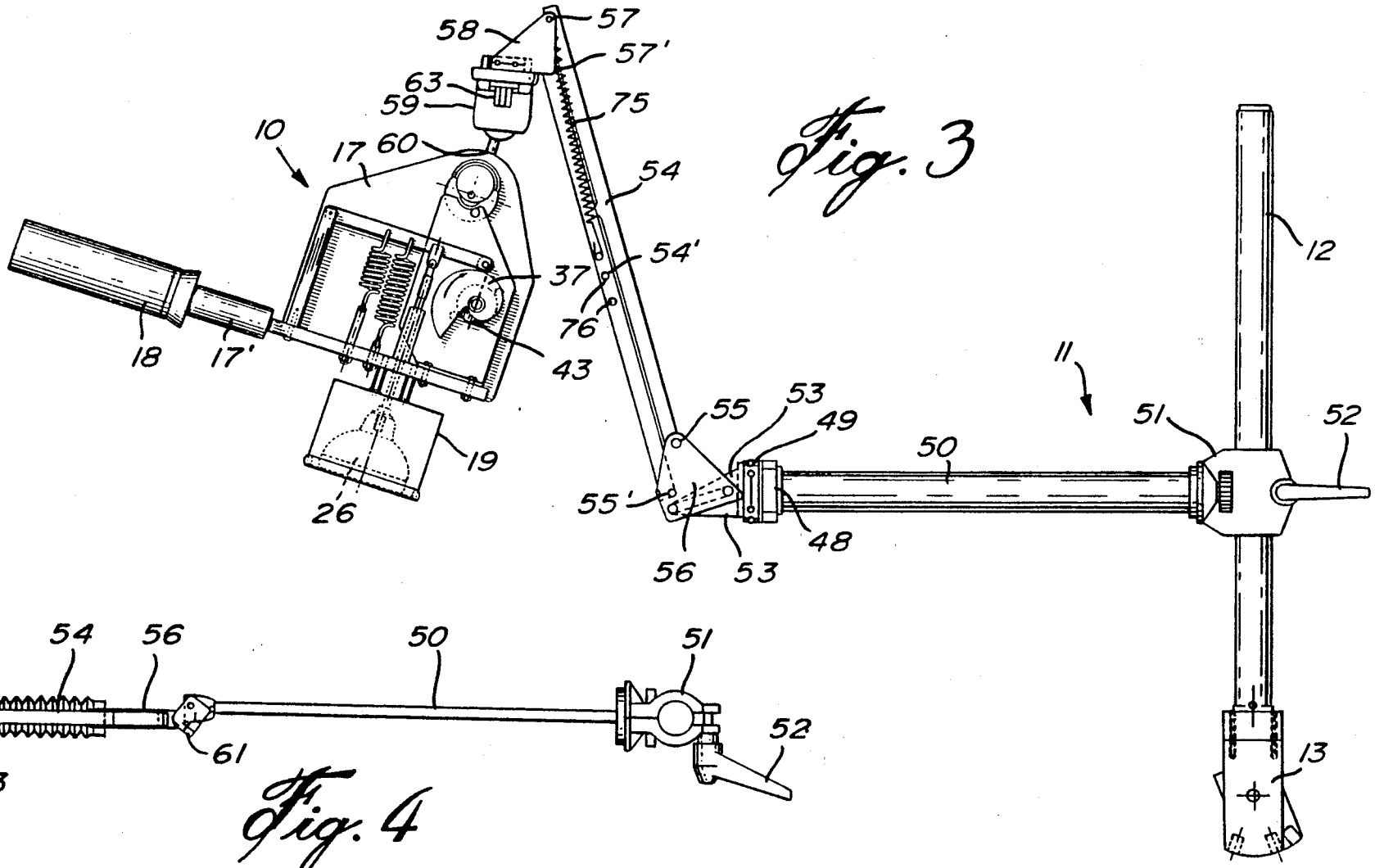
FIG. 3 is a side view illustrating the construction of the articulated support arm and showing the treatment device, partly fragmented, as secured thereto.
Figure 4:
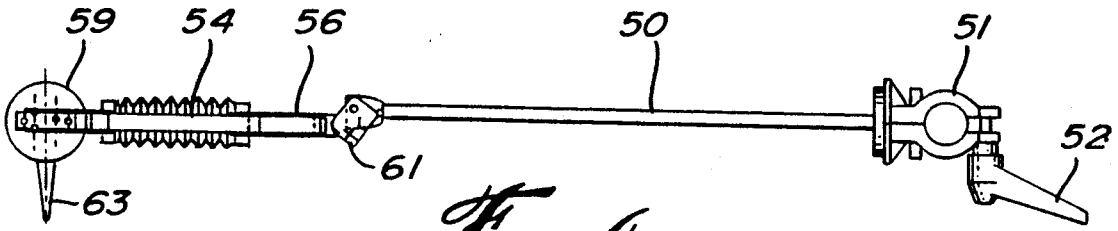
FIG. 4 is a top view of the articulated support arm.

Referring now to FIGS. 3 and 4, there will be described the construction and operation of the adjustable support arm 11 to which is removably connected the treatment device 10 of the present invention. As herein shown, the articulated support arm 11 comprises a vertical post 12 provided with a connector 13 at a lower end whereby to secure the post to a stationary object adjacent to an area where the patient will be treating himself. A horizontal boom 50 is provided with an adjustable fastener 51 at one end whereby to secure it at a selected position along the vertical post 12. A locking arm 52 is provided to clamp the connector 51 at a selected height along the vertical post 12. The other end of the horizontal boom 50 is also provided with a pivotal connector 49 constituted by a U-shape clamp connected to the boom 50 by a pivot pin 48. Accordingly, the clamp 49 can pivot in the horizontal plane.

A support wall 53 is welded to the clamp 49 for connection of a support bracket thereto and constituted by two parallel plates 56. Two straight rods 54 and 54' and extending in side-by-side relationship in a vertical plane and pivotally connected at one end to pivot points 55 and 55' extending between the pair of plate members 56 whereby to vary the vertical angle of the rods 54 and 54'. The other end of the rods 54 and 54' are also connected to separate pivot points 57 and 57' respectively of a top support bracket 58 also constituted by a pair of parallel plates. A pair of springs 75 are connected on a respective side of the rods 54 and 54' and connected at a top end to rod 54 and at a lower end to a selected one of holes 76. These holes provide for adjustment in the tension of the springs whereby to support the weight of the treatment device 10.

A ball joint connector 59 is secured to the support bracket 58 and connects to the top end 60 of the housing 17. A locking lever 63 is provided on the ball joint connector 59 to lock the treatment device 10 at a desired angle relative to the articulated rods 54, as shown in FIG. 3. Accordingly, the articulated boom assembly 11 permits the treatment device 10 to be positioned at a desired angle to suit the needs of the patient. Also, the articulated boom is utilized to support the weight of the device and is adjustable by the patient so that none of the weight of the device or a controlled amount of weight of the device is applied to the patient's body.

Briefly summarizing the operation of the present invention, the treatment device 10 is applied on the patient's body in the rib cage area adjacent the lungs and the machine is switched on. This activates both motors 24 and 43 whereby to operate the vibration generation means as well as the low frequency clapping generation means so that the bell-shaped housing 19 is caused to vibrate to transfer these vibrations to the lung area of the patient and the clapping head 26 is caused to effectuate a low frequency clapping action to impart simultaneous clapping blows in the lung area. Both of these movements imparted to the lung are simultaneously and cause the lungs to expel retained obstructive secretions. The arm 17 with the handle 18 helps the patient to properly locate the treatment head to apply pressure on the device and against his body area. Alternatively, the articulated support arm 11 may also be adjusted to provide pressure by the weight of the device. Furthermore, a strap 70 may be connected to the device and strapped about the chest of the patient to maintain the device in position and to also apply pressure. The patient may also vary the controls on the control module 16 to determine which frequency within the frequency ranges are best suited for his treatment as the beneficial effects are felt by the patient. The patient lies on an angulated treatment table 15 as shown in FIG. 1 and the treatment is applied.

It is within the ambit of the present invention to cover any other obvious modifications of the preferred example described herein, provided such modifications fall within the scope of the appended claims.

We claim:

1. A treatment device for simultaneously applying vibrations and percussion forces to a predetermined area of a patient's body to transfer said vibrations and percussion forces to the area of the patient's lungs, said device comprising a housing having a handle portion, a clapping head disposed exteriorly of said housing and connected to a reciprocable element which is imparted a set low frequency reciprocation movement by a low frequency generation means to impart a clapping action to said head, said head having a contact surface for engagement with said predetermined area of said patient's body, and an independent vibrator element having a body engaging member disposed in relation to said clapping head and connected to a vibratable means, said vibratable means being connected to a vibration generation means capable of vibrating said vibrator element at a higher predetermined frequency than said reciprocation movement of said clapping head.

2. A treatment device as claimed in claim 1 wherein said predetermined area of said patient's body is the back or front rib cage area adjacent the lungs of the patient, said simultaneously applied percussing and vibrating forces causing the expulsion of retained obstructive secretions in the lungs of the patient, said device being secured to an articulated support arm which is fixed to a stationary object, said handle portion of said housing being an elongated handle member engaged by said patient to apply said head and said body engaging member against said predetermined body area.

3. A treatment device as claimed in claim 2 wherein said low frequency generation means imparts a clapping frequency to said clapping head in the range of from 0.5 Hz to 2 Hz.

4. A treatment device as claimed in claim 3 wherein said vibration generation means imparts a vibration frequency to said body engaging member in the range of from 40 Hz to 70 Hz.

5. A treatment device as claimed in claim 4 wherein said body engaging member of said vibrator element is a circumferential gasket-like pad secured to a bell-shaped housing and disposed concentrically about said clapping head, said pad lying substantially in the same plane as said clapping head when at rest.

6. A treatment device as claimed in claim 5 wherein said clapping head has a flat body engaging pad at a treatment end thereof constituting said contact surface, said reciprocable element being a rod connected at one end to said clapping head and at an opposed end to a reciprocating member of said low frequency generation means.

7. A treatment device as claimed in claim 6 wherein said low frequency generation means is comprised of a pivoted arm having a cam engaging end retained in frictional abutment against a cam element by means of spring biasing means, said cam being rotatably connected to an electric motor which is rotated in said low frequency range.

8. A treatment device as claimed in claim 7 wherein said spring biasing means comprises at least one helical spring connected to said pivoted arm to urge said cam engaging end against a side wall of said cam, said cam element having a curved cam wall portion terminating in an abrupt straight end at its longest radius to release said clapping head to simulate a hand clapping action.

9. A treatment device as claimed in claim 8 wherein a guide wheel is secured to said cam engaging end of said pivoted arm, said pivoted arm constituting said reciprocating member of said low frequency generation means.

10. A treatment device as claimed in claim 8 wherein said at least one helical spring is adjustable in tension to adjust the impact force of said flat body engaging pad at said treatment end of said clapping head when released by said cam abrupt straight end.

11. A treatment device as claimed in claim 5 wherein said vibration generation means comprises a motor having a counter weight element secured to an output shaft thereof to cause said housing of said device to which said motor is secured to vibrate and constituting said vibratable means, said bell-shaped housing being connected to said housing of said device so that said vibration frequency is transferred to said bell-shaped housing.

12. A treatment device as claimed in claim 2 wherein said articulated support arm comprises a vertical post having a connector for securement to said stationary object, a transverse horizontal boom having one end adjustably secured along said vertical post, and a pivotal connector secured to an opposite end of said horizontal boom, said pivotal connector having two straight rods pivotally secured thereto in side-by-side relationship in a vertical plane, said straight rods being pivotally connected to a support bracket at a top end thereof, resilient means disposed between connecting points spaced on a respective one of said rods to support said treatment device when connected to said support bracket.

13. A treatment device as claimed in claim 12 wherein a ball-joint connector is secured to said support bracket, said treatment device being secured to said ball-joint connector to permit said housing to be supported at a desired angle.

14. A treatment device as claimed in claim 12 wherein said resilient means is a pair of springs having adjustment means to vary the tension thereof whereby said said support at least part of arm can support the weight of said treatment device or part of said weight device so that a patient lying on an inclined table can place said clapping head and body engaging member on his back by manipulating the position of said device by said articulated support arm so that he may administer himself a treatment by said device.

15. A treatment device as claimed in claim 12 wherein said pivotal connector is a U-shape clamp pivotally connected to said opposite end of said horizontal boom, said one of said rods being retained between a pair of side plates connected to said U-shape clamp.

16. A treatment device as claimed in claim 4 wherein there is further provided adjustment means to adjust said low frequency generation means and said vibration generation means to operate at a fixed frequency in their respective frequency range.

17. A method of applying clapping and vibratory forces simultaneously to a predetermined area of a patient's body adjacent the lungs to cause the expulsion of retained obstructive secretions in the lungs, said method comprising the steps of:

(i) positioning a treatment device having a clapping head and a circumferential vibrator element with said head and element disposed on said predetermined area;

(ii) maintaining said device in position; and (iii) actuating said device so that independent low frequency generating means will cause said clapping head to reciprocate at a frequency in the range of from 0.5 Hz to 2 Hz, and vibration generation means will cause said circumferential vibrator element to vibrate in the frequency range of from 40 Hz to 70 Hz simultaneously.

18. A method as claimed in claim 17 wherein step (ii) comprises applying a pressure by said device against said predetermined body area.

19. A method as claimed claim 17 wherein said step (ii) comprises strapping said device about said patient's body to maintain said device in position.

20. A method as claimed in claim 17 wherein said step (ii) comprises:

(a) supporting said device by means of an articulated support arm; and (b) positioning said device at said predetermined body area by means of an elongated handle member.

21. A method as claimed in claim 17 wherein there is further provided the step of adjusting the frequency of said clapping head and said vibrator element to a selected frequency in their respective frequency ranges.

22. A method as claimed in claim 17 wherein there is further provided the step of adjusting a spring means to select a desired clapping force of said clapping head.

23. A method as claimed in claim 20 wherein there is further provided the step of positioning said patient on an inclined table prior to said step (i) and wherein said steps (i), (ii) and (iii) are self-administered.

* * * * *